US006596932B2

(12) United States Patent
Adams

(10) Patent No.: US 6,596,932 B2
(45) Date of Patent: Jul. 22, 2003

(54) VIBRAPHONE HAVING IMPROVED DRIVE OF FANS

(75) Inventor: André Ansfried J. Adams, Thorn (NL)

(73) Assignee: Adams Paukenfabriek B.V., Thorn (NL)

( * ) Notice: Subject to any disclaimer, the term of this patent is extended or adjusted under 35 U.S.C. 154(b) by 0 days.

(21) Appl. No.: 09/991,278

(22) Filed: Nov. 16, 2001

(65) Prior Publication Data

US 2002/0073824 A1 Jun. 20, 2002

(30) Foreign Application Priority Data

Nov. 16, 2000 (NL) ..... 1016627

(51) Int. Cl.[7] ..... G10D 13/08
(52) U.S. Cl. ..... 84/402; 84/403
(58) Field of Search ..... 84/402, 403, 404, 84/405, 406, 407, 408, 409, 410; D17/22, 23

(56) References Cited

U.S. PATENT DOCUMENTS 3,776,091 A * 12/1973 Suzuki ..... 84/403
5,686,679 A * 11/1997 Nakano et al. ..... 84/402
6,245,978 B1 * 6/2001 Stevens ..... 84/402

* cited by examiner

*Primary Examiner*—Kim Lockett
(74) *Attorney, Agent, or Firm*—Michaelson & Wallace; Peter L. Michaelson

(57) ABSTRACT

A vibraphone provided with at least one series of sound bars with resonance tubes provided thereunder, while above at least a number of the resonance tubes a shaft extends, provided with a series of fans, while driving means are provided for rotation of the or each shaft about its longitudinal axis, such that the fans rotate above the respective resonance tubes, while at least one slip coupling is provided, positioned such that a couple that can be transferred by the driving means to the shaft and/or a fan is limited.

10 Claims, 4 Drawing Sheets

VIBRAPHONE HAVING IMPROVED DRIVE OF FANS

BACKGROUND OF THE INVENTION

1. Field of the Invention

This invention relates to a vibraphone. This invention relates in particular to a vibraphone having shafts with fans, extending above the resonance tubes, driven by a motor with frequency control. Such a vibraphone is known from practice and is supplied, for instance, by Adams Musical Instruments, Ittervoort, the Netherlands.

2. Description of the Prior Art

In the known vibraphone, under two series of sound bars, appropriate series of resonance tubes extend. Above the resonance tubes extend two shafts carrying a series of fans. Driving means are provided for rotation of the shafts with the fans. These driving means comprise a pulley fixedly mounted on the shaft, adjacent the middle thereof, and a frequency controlled motor, with the pulleys coupled via a belt. The motor is mounted under the frame. In this known vibraphone, for the purpose of adjusting the fans relative to each other and the resonator tube, the shafts are to be turned, whereby the respective pulley is rotated relative to the belt, within the loop formed by the belt. This is relatively heavy, and owing to the friction that arises, accurate adjustment is difficult. Moreover, in this known vibraphone, there is a risk that, for instance when adjusting the shafts, a user gets e.g. his fingers caught between the shaft or fan and the resonance tube, entailing the risk of injuries to the user and damage to the vibraphone. Other objects, too, may get caught between the shaft or fan and the resonance tube, entailing the risk of damage to the object and/or the vibraphone. A further disadvantage of this known vibraphone is that the motor, the driving means and the frame part carrying the motor and the sound bars are so constructed that when the vibraphone is to be transported these are to be disassembled completely, and this also requires removing the belts. This is particularly labor-intensive and moreover parts such as the belts may easily be lost.

SUMMARY OF THE INVENTION

The invention contemplates a vibraphone of the type described above, in which the disadvantages mentioned are avoided, while the advantages thereof are maintained. To that end, a vibraphone according to the invention is characterized by the features according to claim 1.

With a vibraphone according to the invention, the advantage is achieved that the or each shaft with the fans can be rotated independently of the driving means when a maximum couple is exceeded. This is because a slip coupling will then be uncoupled. This means that during drive of the driving means the respective shaft with the fans can be decelerated and stopped without this damaging the driving means, thereby simply preventing the pinching of fingers and the like. Moreover, also with the driving means at a standstill, the shaft with the fans can be rotated relative to the driving means, for instance for adjusting the position of the fans, in that it can be simply rotated through the slip coupling. This enables adjustment of the fans in a particularly simple and accurate manner.

In further elaboration, a vibraphone according to the invention is characterized by the features according to claim 2.

In such an embodiment, the advantage is achieved that the or each slip coupling can be simply fitted and be accessed.

In a further advantageous embodiment, a vibraphone according to the invention is characterized by the features according to claim 5.

The use of first and second coupling means provides the advantage that the shaft can be easily detached from the driving means, in particular from the slip coupling, for instance during disassembly for the purpose of transport, maintenance, repair, replacement or the like.

In a further elaboration, such a vibraphone according to the invention is further characterized by the features according to claim 6.

In such an embodiment, the motor with the driving means can be disassembled as a unit. This considerably simplifies, for instance, transport of the vibraphone, while parts are kept together. Loss of parts, improper assembly and the like are thereby prevented.

In a further advantageous embodiment, a vibraphone according to the invention is further characterized by the features according to claim 8.

Thus, an adjusting wheel provides the advantage that the shaft, together with the fan, can be simply turned by hand, which requires little force, so that a still more accurate adjustment is possible, precisely when using the slip coupling.

It is preferred that the shafts are bearing-mounted in bearing housings connected with a common base plate. As a result, a particularly simple construction is obtained. By providing the driving means on the side of the base plate remote from the shafts, the advantage is achieved that the driving means, in particular belts, ropes or the like thereof, are screened with respect to the shafts. This affords the possibility of turning the shafts and fans without this entailing the risk of a user coming into contact with the driving means.

In the further subclaims, further advantageous embodiments of a vibraphone according to the invention are described.

BRIEF DESCRIPTION OF THE DRAWINGS

In clarification of the invention, exemplary embodiments of a vibraphone according to the invention will be further elucidated with reference to the drawing. In the drawings.

DETAILED DESCRIPTION

Figure 1:
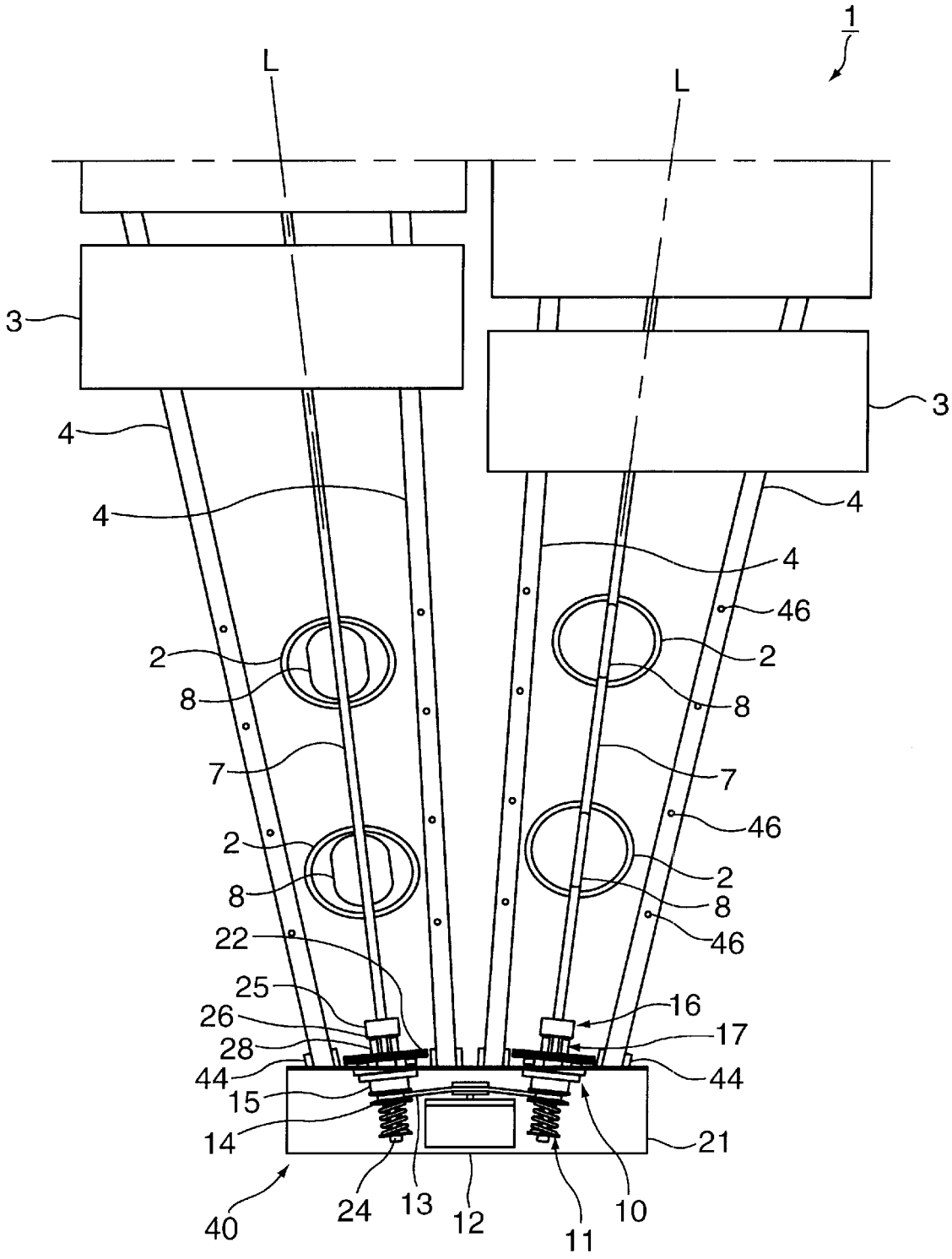
FIG. 1 schematically shows in top plan view a portion of a vibraphone with a number of sound bars, resonance tubes and driving means according to the invention.

In this description, the same or corresponding parts have the same or corresponding reference numerals.

FIG. 1 schematically shows, in top plan view, a vibraphone 1 according to the invention with resonance tubes 2. The vibraphone 1 comprises two series of sound bars 3, arranged in the usual manner in mutually staggered relation and carried by respective frame parts 4. A number of sound bars 3 have been omitted for the sake of clarity. In a manner to be described hereinafter in more detail, the frame parts 4 are connected to legs 5 (see FIG. 4) by which the vibraphone is supported on the ground. Between the frame parts 4, resonance tubes 2, one under each sound bar 3, are arranged, likewise in a manner known per se, for instance supported adjacent their upper end between the frame parts 4. The resonance tubes 2 are suspended in two diverging rows. Above each resonance tube 2 extends a shaft 7 (see FIG. 7) on which a series of fans 8 are secured, one above each resonance tube 2. The shafts 7 are bearing-mounted adjacent their ends, while adjacent one end a bearing 10 with driving means 11 is provided, which will be discussed hereinafter in more detail. The fans 8 have a substantially round cross section with two flattened sides, such that they can rotate above the cylindrical resonance tubes 2 through rotation of the shaft 7 about its longitudinal axis L. When playing the vibraphone, the shafts 7 with the fans 8 are rotated with the aid of the driving means 11, so that a vibrato tone is obtained. To that end, the driving means 11 comprise a motor 12 with frequency control, which is connected via a belt 13 with a driving wheel, in particular a pulley 14, with the shaft 7, via a slip coupling 15, which will be further discussed hereinbelow. The use of a motor 12 with frequency control and belt transmission is sufficiently well known per se.

Figure 2:
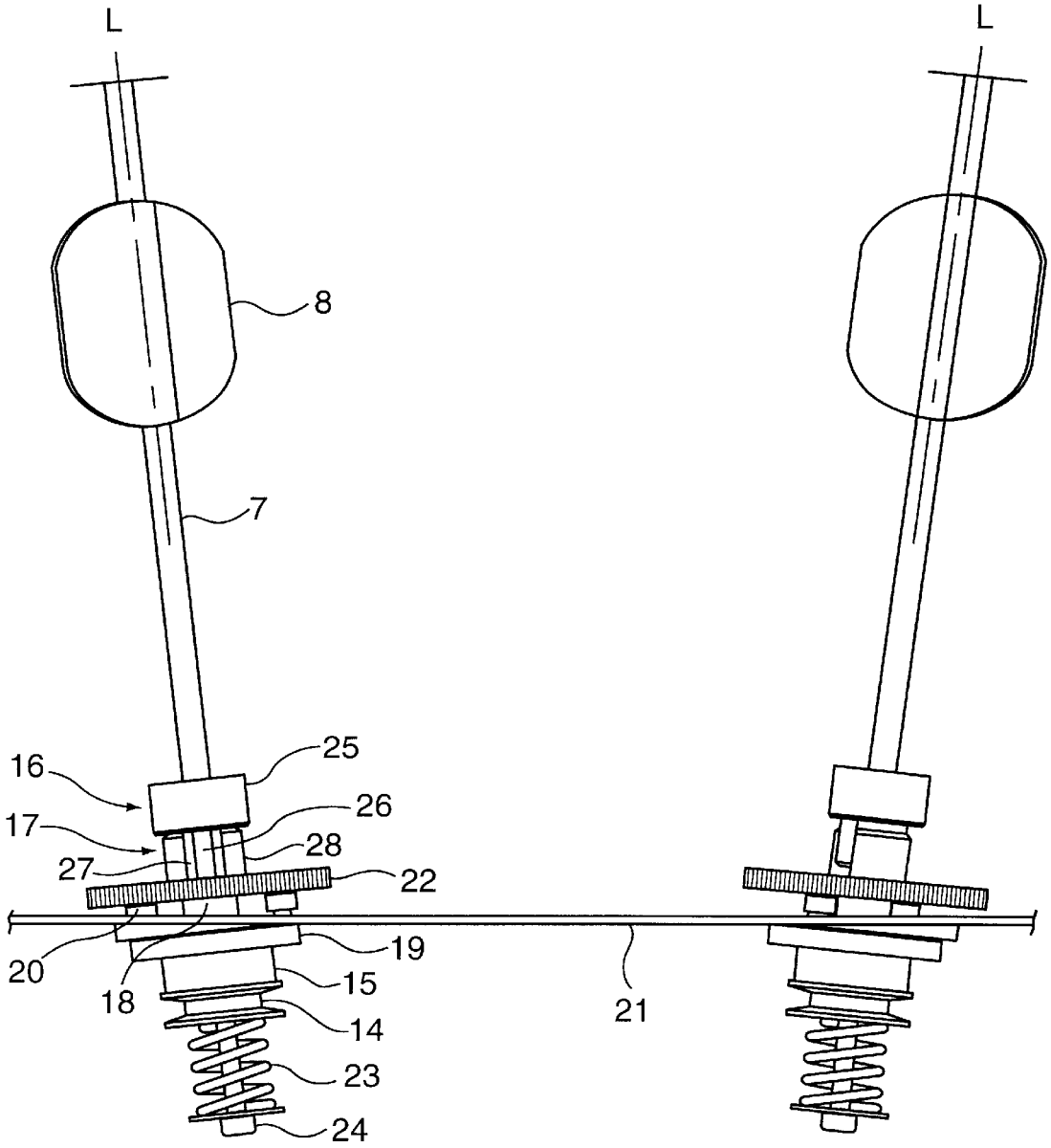
FIG. 2 shows in side elevation a base plate with two shafts with fans and driving means, provided with slip couplings according to the invention.
Figure 3:
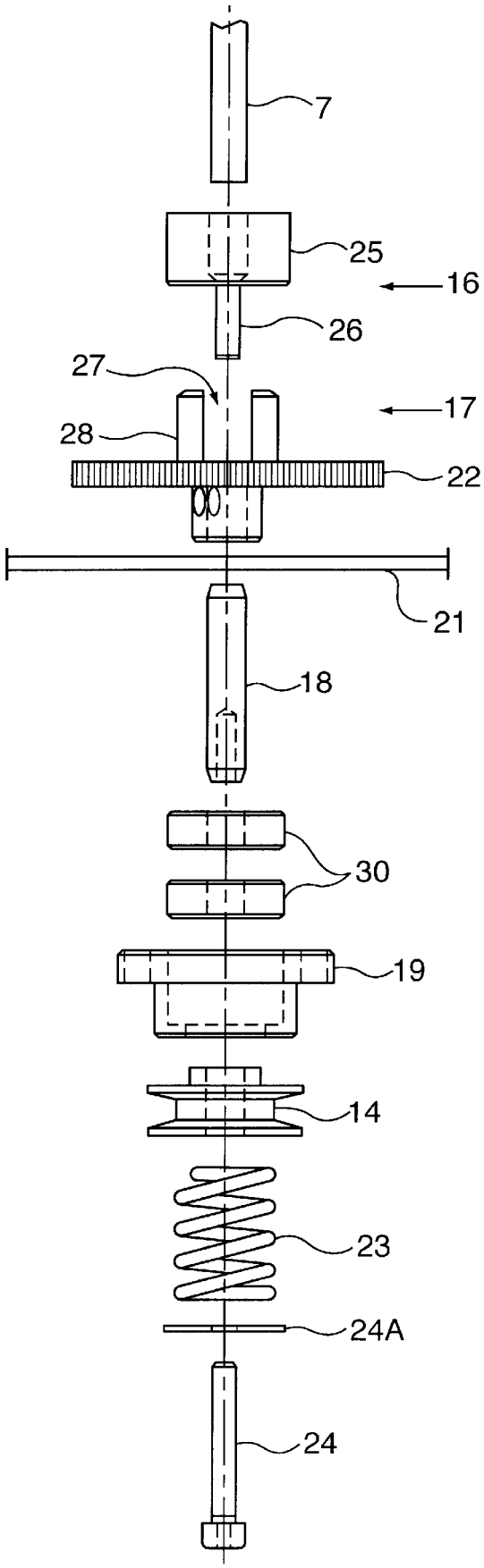
FIG. 3 shows in exploded view a part of the driving assembly with a part of the driving means, a slip coupling and shaft bearing, coupled with a shaft with fans according to the invention.

In a vibraphone according to the invention, the shaft 7 with the fans 8, as elucidated in more detail in FIGS. 2 and 3, is coupled via first coupling means 16 and, cooperating therewith, second coupling means 17, to a support shaft 18 which is bearing-mounted in a bearing housing 19. The bearing housing 19 is secured with the aid of bolts 20 or like fasteners against the underside of a base plate 21, with the support shaft 18 extending through the base plate 21. Arranged between the second coupling means 17 and the support shaft 18 is an adjusting wheel 22 with outer teeth for improved grip. The adjusting wheel 22 has a diameter which is considerably greater than the diameter of the shaft 7. As a consequence, with relatively little force exerted on the adjusting wheel, the shaft 7 can be rotated about its longitudinal axis L. Arranged between the bearing housing 19, at least the support shaft 18, and the driving wheel 14 is a slip coupling 15. Slip couplings are known from practice. In this embodiment, the pulley-shaped driving wheel 14 is pressed down and tensioned with the aid of a spring 23. This bias can be adjusted with the aid of a bolt 24, so that the slip coupling 15 can be limited at a desired couple. In FIGS. 2 and 3 the belt 13 which, during use, engages the pulley 14 has been omitted for clarity.

A vibraphone according to the invention can be used as follows.

During use, the motor 12 is switched on, such that with the aid of the belt 13 the shafts 7 with the fans 8 are rotated above the resonance tubes 2, so that upon striking the sound bars 3 the desired vibrato tone is obtained. If desired, preferably with the motor switched off, the shafts 7 with the fans 8 can be turned relative to each other and the base plate 21, above the resonance tubes 2, through engagement of the respective adjusting wheel 22. Owing to the slip coupling 15, the shaft 7 can be rotated without rotation of the pulley 14 and the belt 13, which enables adjustment in a simple and accurate manner. Even with the motor 14 switched on, such an adjustment can, in principle, be carried out, by simply retaining the adjusting wheel 22, without this entailing the danger of injuries or damage.

In the exemplary embodiment shown, the longitudinal axes L, in the conventional manner, include a mutual angle a (not specifically shown) of, for instance, about 10°. The base plate 21 provides the advantage that the driving means 11 are screened from the adjusting wheels 22 and the shafts 7, thereby eliminating the risk of a user coming into contact with the driving means when operating the adjusting means. The angle β corresponds to the angle between the two rows of resonance tubes 2.

In the embodiment shown, the first coupling means 16 are designed as a cylindrical part 25 with a flat projection 26. The second coupling means 17 comprise two parts 28 enclosing a slot 27, while the projection 26 can be received between the two parts 28 with a proper fit. This means that the projection 26 can be detached from the second coupling means 17 through axial movement of the shaft 7, and also can be laterally slipped out of them. This enables assembly and disassembly in a particularly simple manner. Moreover, undesired couples on the shaft 7 can thus be prevented.

FIG. 3 shows, in exploded view, the assembly for driving a shaft 7. There is shown the end of the shaft 7, adapted to be screwed into the first coupling means 16. Shown thereunder is the adjusting wheel 22 with the second coupling means 17. The support shaft 18 can be inserted through the base plate 21 into the adjusting wheel 22 and be secured therein so as to be locked against rotation relative thereto. Confined side by side in the bearing housing 19 are two bearings 30, in which the support shaft 18 is journaled. This bearing housing 19 is to be secured against the base plate 21. With the bolt 24 and a lock plate 24 A, the spring 23 is pressed against the driving wheel 14. The bolt 24 is screwed into the end of the support shaft 18, to the extent where the desired pressure is exerted on the driving wheel. If on the shaft 7 or the fan 8 a pressure is exerted that is greater than is desired, the driving wheel 14 will slip relative to the spring 23 and the bearing housing 19, so that the shaft 7 will not then be driven. Thus a slip coupling 15 is formed.

Figure 4:
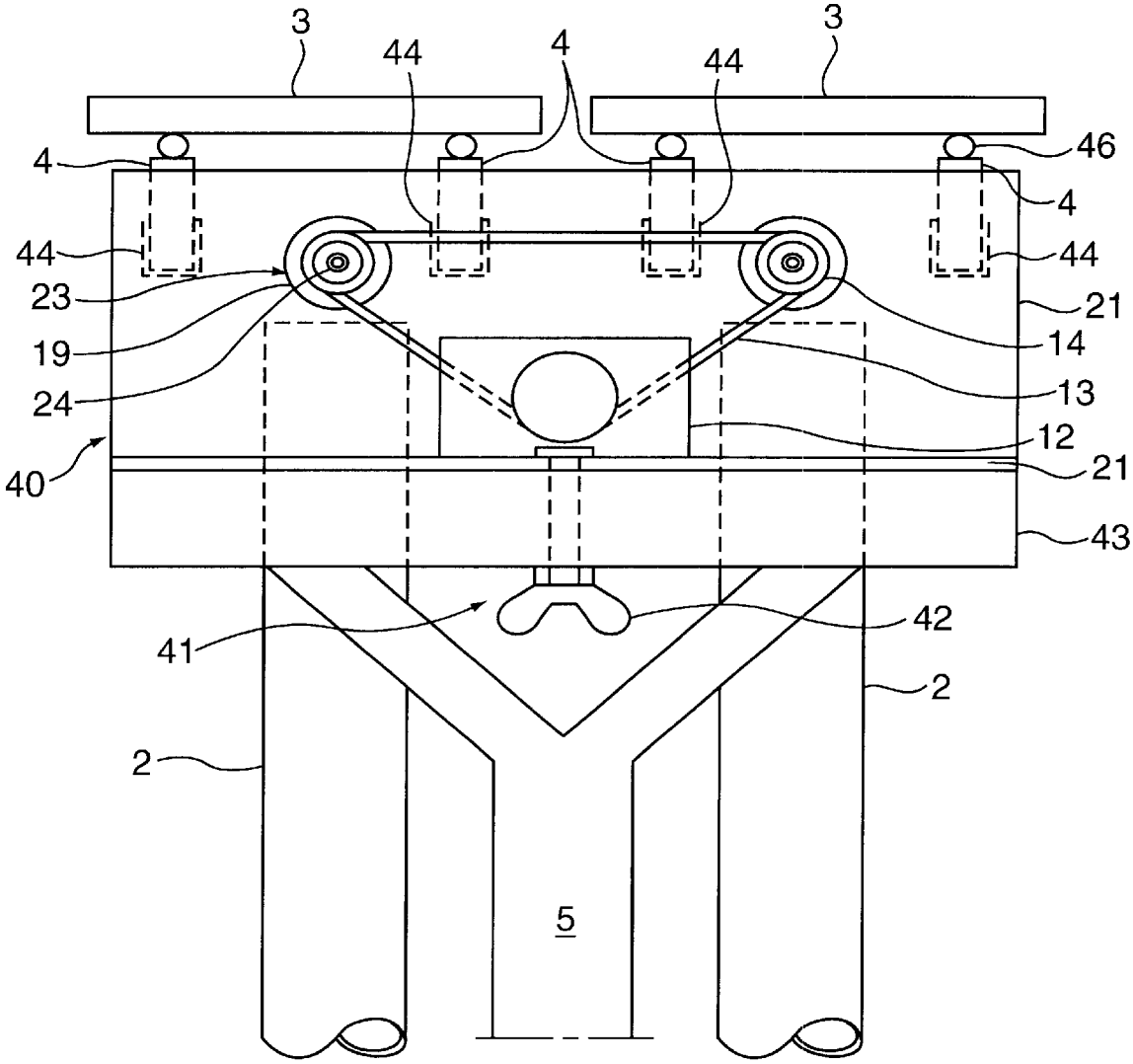
FIG. 4 schematically shows in side elevation a vibraphone with a head unit according to the invention, with the cap removed.

FIG. 4 shows in side elevation a portion of a vibraphone 1 according to the invention, with the covering cap removed. In this elevation, there is clearly shown a head unit 40, in which the motor 12, the driving wheels 14 and the belt 13 are mounted, against the base plate 21 bent at right angles. With the aid of a bolt connection 41, including, for instance, a wing nut 42, the head unit 40 is mounted on a cross beam 43 of the leg 5. Undoing this bolt connection has as a result that the head unit 40 as a whole can be detached and be stored, in particular also because the first coupling means 16 can be simply detached from the second coupling means 17. The belt 13 can then remain connected with the driving wheels 14 and the motor 12.

As appears clearly from FIGS. 1 and 4, against the substantially vertical side of the base plate 21 remote from the motor, there are fitted four U-shaped brackets 44, in which rest the frame parts 4 designed as laths. On the side of the vibraphone remote from the head unit 40, a comparable head unit is arranged on the leg 5 present there (not shown), but without motor 12 and further driving means 11. In this second head unit, the shafts 7 are bearing-mounted and the same U-shaped brackets are provided for carrying the laths 4. The laths 4 are preferably disposed loosely in the brackets 44, so that they can be readily removed after removing the sound bars 3 from the supporting elements 46 arranged on the laths 4. As a result, in a simple manner, the vibraphone can be disassembled and transported and stored. Incidentally, it is already an advantage that the motor with driving means is incorporated adjacent an end of the shafts, instead of adjacent a central part as in the known vibraphone, since this already facilitates assembly and disassembly in that the belt does not have to be slipped over the shaft. Moreover, more space is kept clear under the sound bars and resonator tubes.

The invention is not in any way limited to the exemplary embodiment represented in the drawing and the description. Many variations thereon are possible within the scope of the invention. Thus, slip couplings of a different kind can be utilized, arranged in any suitable manner between the driving means, in particular the motor 12, and the shaft 7, more particularly the adjusting wheel 22. Also, shafts may be driven in groups or even individually by a motor with a slip coupling coupled thereto. The shaft 7 can be connected directly with the adjusting wheel 22 and the support shaft 18. The slip coupling can be integrated with a driving wheel. The frame can, of course, be built up in any desired manner.

These and many comparable variations are understood to fall within the scope of the invention as outlined by the claims.

What is claimed is:

1. A vibraphone comprising:

at least one series of sound bars with resonance tubes provided thereunder;

a shaft extending above respective ones of the resonance tubes, the shaft being provided with a series of fans;

driving means for rotating the shaft about its longitudinal axis such that the fans rotate above the respective resonance tubes; and at least one slip coupling positioned so as to limit torque that can be transferred from the driving means onto the shaft or the fan.

2. The vibraphone recited in claim 1 wherein the slip coupling is situated near an end of the shaft and between the shaft and the driving means.

3. The vibraphone recited in claim 1 wherein the driving means comprise a driving wheel connected, via the slip coupling, with a motor and with the shaft.

4. The vibraphone recited in claim 3 wherein the driving means comprise a belt or rope, which engages the driving wheel, and a frequency controller coupled to the motor.

5. The vibraphone recited in claim 1 wherein the shaft is provided, adjacent to a first end thereof, with first coupling means, and the slip coupling is connected with second coupling means; and wherein the first and second coupling means are detachable from each other through axial or radial movement of the shaft relative to the slip coupling.

6. The vibraphone recited in claim 5 further comprising a motor and a driving wheel, the driving means being a belt or rope which connects the motor with the driving wheel; and wherein the motor, the driving wheel and the driving means are detachable as a unit from a remainder of the vibraphone.

7. The vibraphone recited in claim 6 further comprising two head units, carried by a frame, between which a series of laths is detachably suspended on which the sound bars are carried, one of the head units comprises the motor and the driving means, and wherein the shaft is bearing-mounted in both of the head units.

8. The vibraphone recited in claim 1 further comprising an adjusting wheel, provided on the shaft and having a cross-section greater than a cross-section of the shaft, through which the fans, together with the shaft, can be rotated for positional adjustment of the fans relative to the driving means.

9. The vibraphone recited in claim 1 further comprising a base plate on which the shaft and the second coupling means are collectively mounted.

10. The vibraphone recited in claim 1 wherein the slip coupling is kept under tension through use of a spring.

* * * * *